US007444801B2

(12) United States Patent
Rosenwasser et al.

(10) Patent No.: US 7,444,801 B2
(45) Date of Patent: Nov. 4, 2008

(54) METHOD OF WEAVING LINKS AND RESULTING PRODUCT

(75) Inventors: David Rosenwasser, Norwood, NJ (US); Avraham Rosenwasser, Norwood, NJ (US)

(73) Assignee: Avraham Rozenvasser, Lima (PE)

( * ) Notice: Subject to any disclaimer, the term of this patent is extended or adjusted under 35 U.S.C. 154(b) by 0 days.

(21) Appl. No.: 11/197,130

(22) Filed: Aug. 4, 2005

(65) Prior Publication Data

US 2006/0032208 A1 Feb. 16, 2006

Related U.S. Application Data

(60) Provisional application No. 60/598,996, filed on Aug. 5, 2004.

(51) Int. Cl.
*B21L 5/02* (2006.01)
*F16G 13/00* (2006.01)

(52) U.S. Cl. ..... 59/80; 59/35.1; D11/13

(58) Field of Classification Search ..... 59/3, 59/35.1, 80, 82, 83; D11/13
See application file for complete search history.

(56) References Cited

U.S. PATENT DOCUMENTS

| | | | | | |
|---|---|---|---|---|---|
| 3,733,852 | A * | 5/1973 | Johnson et al. | ..... | 63/37 |
| 4,651,517 | A * | 3/1987 | Benhamou et al. | ..... | 59/80 |
| 4,934,135 | A * | 6/1990 | Rozenwasser | ..... | 59/80 |
| 4,996,835 | A * | 3/1991 | Rozenwasser | ..... | 59/80 |
| 5,185,995 | A * | 2/1993 | Dal Monte | ..... | 59/80 |
| 6,311,470 | B1 * | 11/2001 | Rosenwasser et al. | ..... | 59/80 |
| D476,591 | S * | 7/2003 | Klein et al. | ..... | D11/13 |
| 6,807,800 | B2 * | 10/2004 | Rosenwasser et al. | ..... | 59/80 |
| 6,892,521 | B2 * | 5/2005 | Rosenwasser et al. | ..... | 59/35.1 |

* cited by examiner

*Primary Examiner*—David B Jones
(74) *Attorney, Agent, or Firm*—Katten Muchin Roseman LLP

(57) ABSTRACT

Methods of weaving decorative rope chains are disclosed. Chain links having gaps are assembled with all of the gaps oriented in the same direction. Accordingly, the links are interconnected one into the next in a helix configuration with each of the gaps facing in the same direction. One or more wire strands may be intertwined in the valleys of the helix configuration and remain in place to retain the helix configuration. The resulting rope chain itself may be used to form links for forming new types of chains.

26 Claims, 5 Drawing Sheets

METHOD OF WEAVING LINKS AND RESULTING PRODUCT

CROSS-REFERENCE TO RELATED APPLICATIONS

The present invention claims priority to U.S. Provisional Patent Application No. 60/598,996 entitled "METHOD OF WEAVING LINKS AND RESULTING PRODUCT" filed Aug. 5, 2004, which is hereby incorporated herein for all purposes.

BACKGROUND OF THE INVENTION

1. Field of Invention

The present invention relates to jewelry chains and more specifically jewelry rope chains.

2. Discussion of Prior Art

One well known type of chain is a jewelry rope chain. Such chain is formed by interweaving links. The links can be of any shape including annular, square, triangular, or any other shape. The links can be formed of any shape wire such as round, square, triangular, or other shape. Additionally, the wire used may be hollow or solid material. Furthermore, hollow wire may include an interior seam or it may be seamless.

In standard rope chains, the links are formed with a gap in the exterior periphery. The links are assembled with the gap up and thereafter the next link is inserted with the gap down relative to the first link. This alternating arrangement of gap up and gap down is continued in a grouping fashion. Different ratios of the inner diameter of the links to the wire diameter may be used but conventional rope chains use a 3:1 ratio or larger (e.g., 5:1, 7:1, etc.). In a chain with a 3:1 ratio, the links are intertwined with two links fitting within the interior of a third link.

Typically, during manufacture of conventional rope chains, the links are temporarily held in place by two wires that are wound around the valleys of the double helix configuration formed by the links being interconnected. Thereafter, the links are soldered together in an alternating fashion. The wires are then removed and the links remain in place. The links provide a continuous interconnected chain which is flexible.

The above described typical arrangement is explained in more detail in U.S. Pat. No. 4,651,517 which is hereby incorporated herein by reference. Chains having a 3:1 ratio are described and additional odd ratios of 5:1, 7:1, 9:1, etc. are also described. In U.S. Pat. No. 4,934,135, which is hereby incorporated herein by reference, an arrangement using even ratios is described. Adjacent links are connected with their gaps oriented in the same direction and thereafter, additional links are inserted with their gaps oriented in the opposite direction. The number of links that fit within another link depends upon the ratio.

In U.S. Pat. No. 6,807,800, which is hereby incorporated herein by reference, a method is disclosed wherein links are arranged so that their gaps are not oriented in a continuously alternating pattern up and down. However, the links in the '800 patent are arranged so that some alternating of gap orientation is involved in the interweaving of the links to form the chain.

U.S. Pat. No. 6,311,470, which is hereby incorporated herein by reference, describes a reinforced rope chain. The disclosed rope chain is assembled from thin walled links in the classic manner (i.e., using an alternating gap orientations) and then reinforcing strands of precious metal are permanently attached (e.g., instead of the standard temporary metal wires). The precious metal strands remain in place even after the links are intertwined. The disclosed invention permits the utilization of thinner walled links and the intertwined precious metal strands provide strength and support to compensate for the thinner walled links.

SUMMARY OF THE INVENTION

The present invention contemplates the use of links with gaps. The links are assembled with all of the gaps oriented in the same direction. Accordingly, the links are interconnected one into the next in a helix configuration with each of the gaps facing in the same direction. One or more wire strands may be intertwined in the valleys of the helix configuration and remain in place to retain the helix configuration.

Another aspect of the invention is to utilize the rope chain produced as described above as a wire for forming individual links to be used for constructing a new type of rope chain. The new links, referred to herein as compound links, may be used to form other types of new chains including types having otherwise well known configurations (but for the use of the inventive compound links). In alternative embodiments, standard rope chain with alternating gap orientations may be used to construct the compound links. Further, in yet other alternative embodiments, any type of chain may be used to construct the compound links.

In a further aspect of the invention, links (e.g., either conventional or compound) are assembled into a rope chain configuration and then each link is rigidly interconnected (e.g., using solder) to the next adjacent link. This is in contrast to conventional chains wherein the links were specifically not all interconnected to each other in order to retain flexibility. The resulting substantially rigid chain may then be bent specifically into any shape desired, such as an arc, a circle for a bracelet, or necklace.

Other features and aspects of the present invention will become more fully apparent from the following detailed description of exemplary embodiments, the appended claims, and the accompanying drawings.

DETAILED DESCRIPTION OF THE INVENTION

Figure 1:
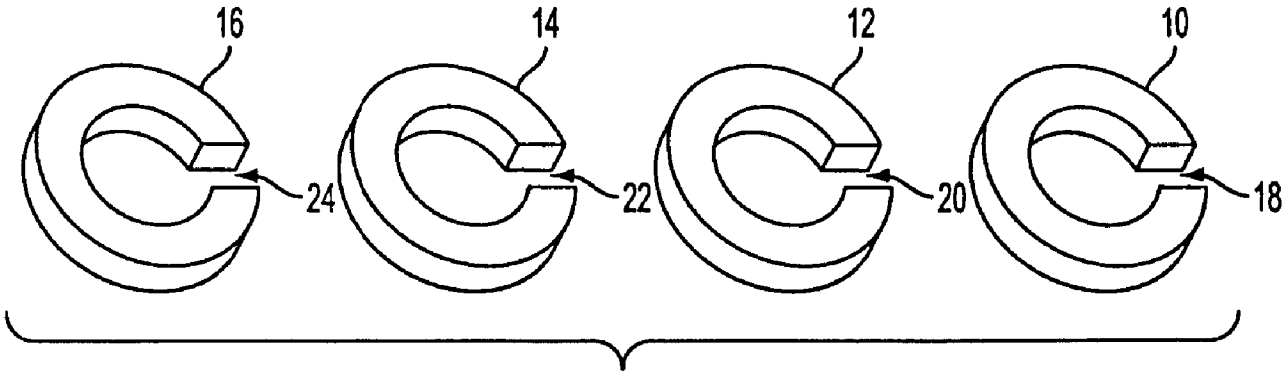
FIG. 1 is a perspective view depicting individual links to be utilized in accordance with some embodiments of the present invention.

While this invention is illustrated and described in a preferred embodiment, the device may be produced in many different configuration, forms and materials. There is depicted in the drawings, and will herein be described in detail, a preferred embodiment of the invention, with the understanding that the present disclosure is to be considered as an exemplification of the principles of the invention and the associated functional specifications for its construction is not intended to limit the invention to the embodiment illustrated. Those skilled in the art will envision many other possible variations within the scope of the present invention.

Reference will now be made in detail to embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as upper, lower, top, bottom, left, right, up, down, over, above, below, beneath, rear, and front may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices. Furthermore, such terms as "conventional chain," "conventional rope chain," "classic chain," and "standard chain" are used interchangeably. The following detailed description is of the best mode or modes of the invention presently contemplated. As indicated above, such description is not intended to be understood in a limiting sense, but to be an example of the invention presented solely for illustration thereof, and by reference to which in connection with the following description and the accompanying drawings one skilled in the art may be advised of the advantages and construction of the invention.

The present invention employs links in a novel method of forming a chain. As in conventional rope chains, the links can be of any configuration including annular, square, triangular, or any other shape. Furthermore, the links can be made of any type of wire such as round, square, triangular, etc. In addition, the wire and/or links can be stamped out of sheet material. Additionally, the wire can be made of hollow or solid material, and, if hollow, may be either seamed or seamless. Any type of links that can be interwoven are contemplated for use in the present invention.

FIG. 1, by way of example, depicts four annular links 10, 12, 14, 16 that along with additional links may be used to construct a chain according to the present invention. The links 10, 12, 14, 16 each have gaps 18, 20, 22, 24, respectively.

Figure 2:
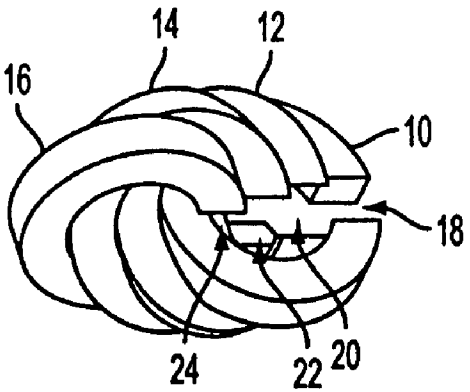
FIG. 2 is a perspective view depicting the links of FIG. 1 intertwined in accordance with some embodiments of the present invention.

With reference to FIG. 2, the links 10, 12, 14, 16 are interconnected with all of the gaps 18, 20, 22, 24 oriented in the same direction. One link 16 is placed over the other links 10, 12, 14 so that it overlies the links 10, 12, 14. To form a chain, additional links are added one upon the other. In doing so, the links form a helix configuration with two valleys on either side of the chain defined by the gaps 18, 20, 22, 24.

Figure 3:
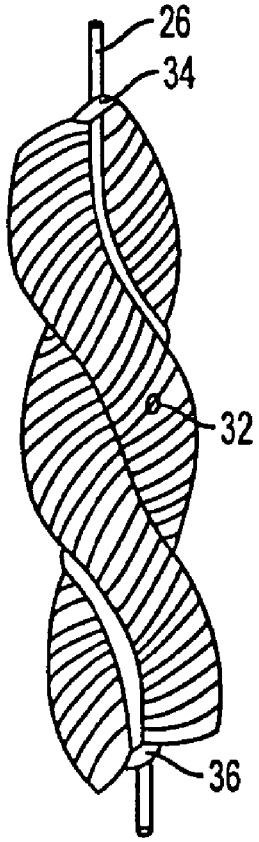
FIG. 3 is a perspective view depicting the intertwined links held in place by a fixed strand in accordance with some embodiments of the present invention.
Figure 4:
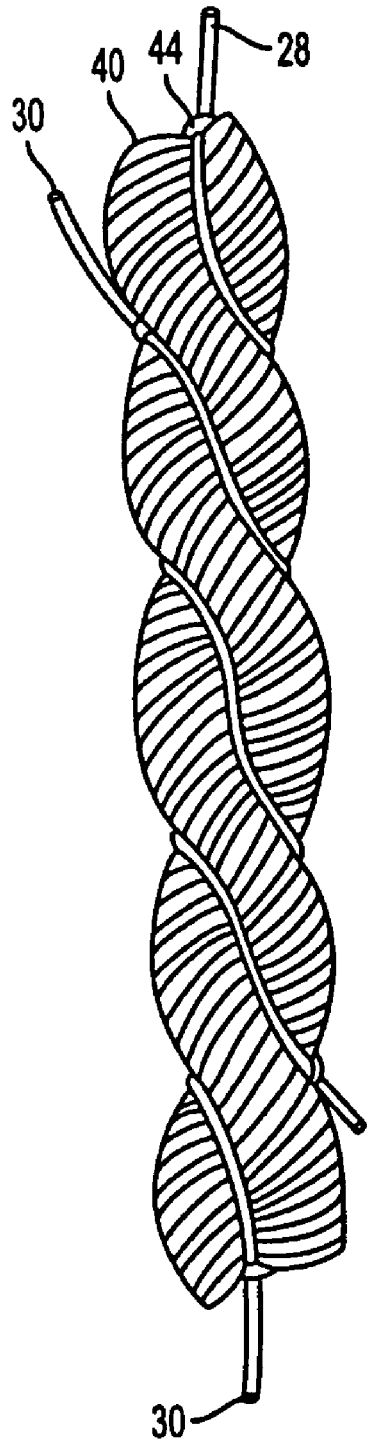
FIG. 4 is a perspective view depicting the links held in place by two fixed strands in accordance with some embodiments of the present invention.

As shown more clearly in FIG. 3, the links are interwoven in this manner to form a helix configuration. Wire strands 26 are then twisted into the valleys of the helix configuration. FIG. 3 shows the use of one such strand in one of the two valleys. FIG. 4 shows the use of two such strands 28, 30, one in each of the two valleys.

The strands 26, 28, 30 may be made from precious metal to complement the material of the links. The strands 26, 28, 30 may be either the same type of metal as the links, or, in some embodiments, a different precious metal. For example, the links may be made of gold while the strands 26, 28, 30 may be made of gold, silver, platinum, or the like. Furthermore, the strands 28, 30, if two are used, need not both be made of the same precious metal. For example, one strand 28 may be gold and one strand 30 may be silver. Other combinations can also be used.

After one or more strands have been wrapped into the valleys, the links are secured to each other and/or to the strand(s). The links may be secured to each other by soldering adjacent links, as shown by way of example at solder point 32. Such solder points could be formed throughout the length of the intertwined links. The links may also be secured to the strand(s). In some embodiments, a strand 26 may be attached to the intertwined links at solder points 34, 36 disposed at either end of the strand 26. In addition, the intertwined links may be secured to the strand(s) at intermittent points along the strand(s). Thus, the strands, either one or two, are left in place to retain the intertwined links in the helix configuration. The resulting chain may be used by itself as a rope chain or as a rope chain portion in part of another piece of jewelry such as a bracelet, earring or the like. In some embodiments, one or more segments of the resulting chain may be connected to conventional rope chain to form a combination rope chain.

Figure 5:
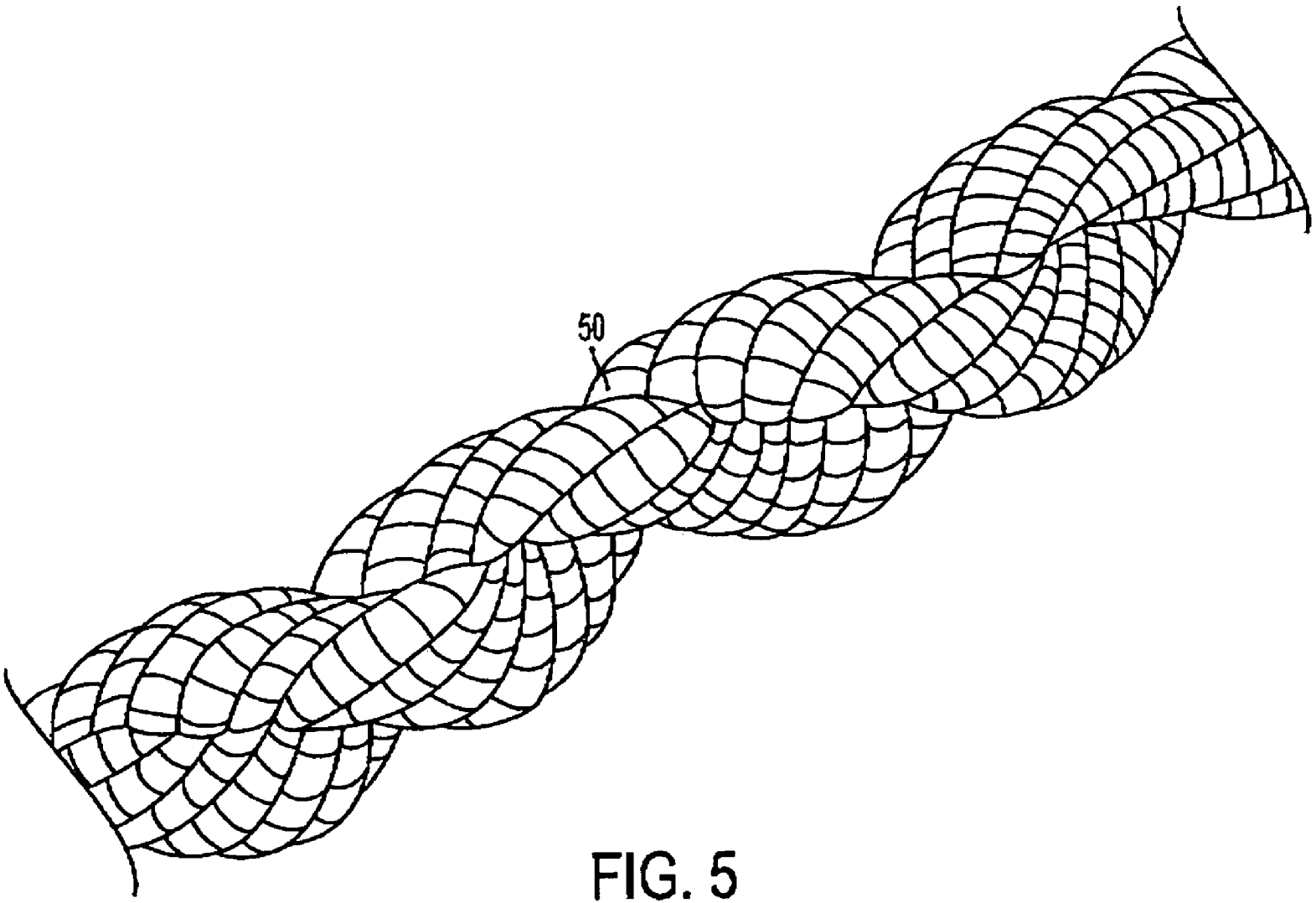
FIG. 5 is a perspective view depicting a rope chain constructed from compound links made in accordance with some embodiments of the present invention.
Figure 6:
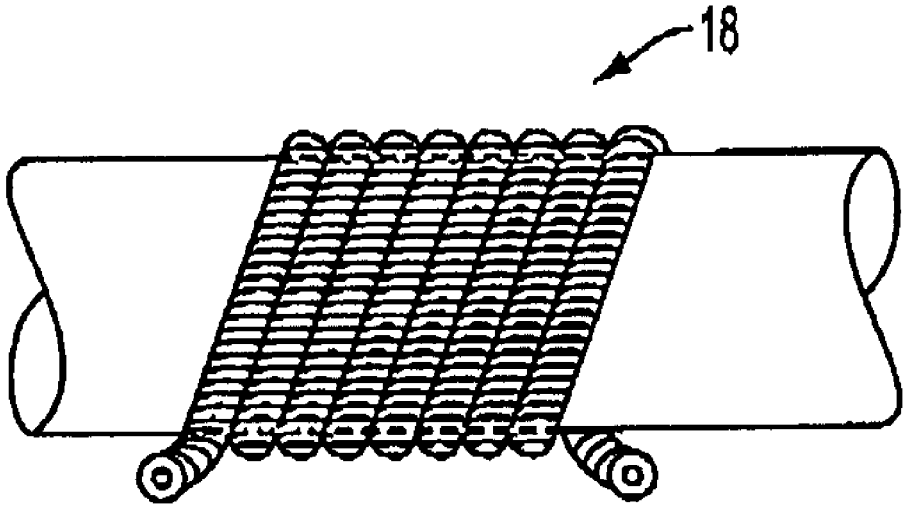
FIG. 6 is a side view of a helical chain of FIG. 3 or 4, wound prior to forming links therefrom.
Figure 7:
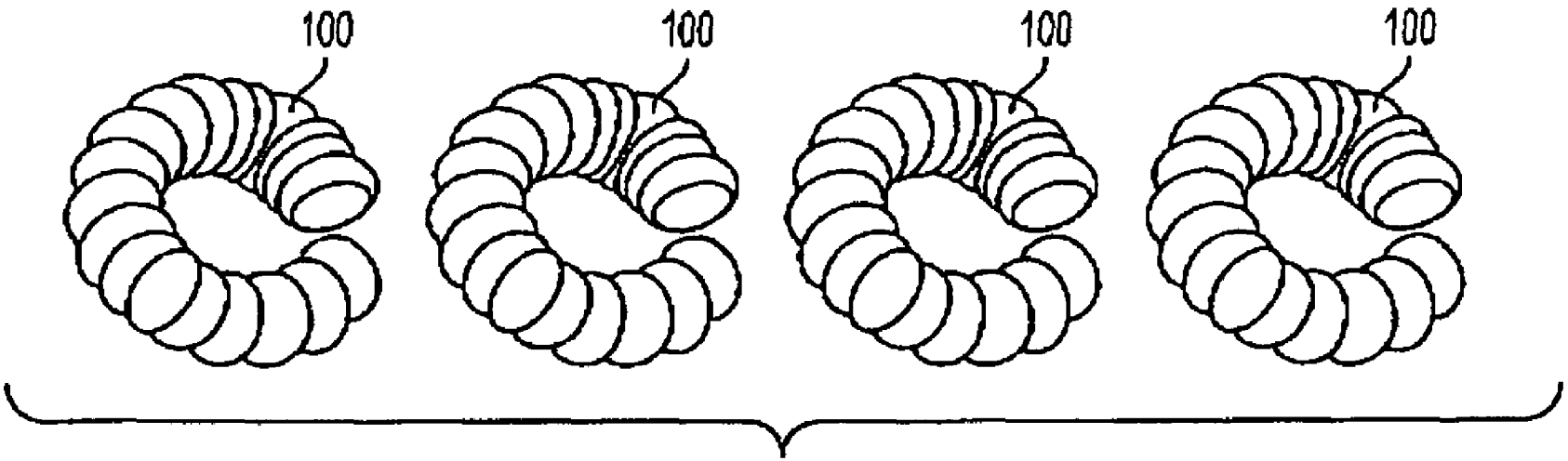
FIG. 7 is a perspective view of links formed from a helical chain.

In additional embodiments, the resulting chain may be used like a wire to form individual links for use in manufacturing new types of chains. Specifically, such interconnected serpentine helix configuration can be formed into a new link by winding such serpentine connected rope chain and using it as a new unified strand in place of the wire, as shown in FIG. 6. In other words, the chains depicted in FIGS. 3 and/or 4 may be cut or formed into pieces of an appropriate length and thickness. The pieces may be shaped into annular (or other shape) links, as shown in FIG. 7. Such links may be referred to herein as compound links. The compound links may be used to construct a new type of chain. For example, FIG. 5 depicts a rope chain that is constructed from such compound links 50. Such a rope chain may be referred to as a compound rope chain.

The compound links may be shaped by wrapping the pieces (or all) of the helix configuration chain around a mandrel. Compound links may thus be of any shaped configuration such as round, square, oval, etc., depending upon the mandrel that is used. The resulting compound links can be assembled in any fashion desired to form a new type of chain whether it be a rope chain, a slalom chain, etc.

While the above embodiments use links assembled with the gaps oriented in the same direction, it should be appreciated that the inventive concept of using compound links can be applied to chains with links in opposing orientations as in the classic rope chain, or to chains with some links in one directions and some links in the other direction. Specifically, any formation of a rope chain using any intertwining of the links can result in a rope chain configuration. Thereafter, it is contemplated by the present invention that such rope chain, regardless of the assemblage of the links in whatever direction and whatever method they are made, can then be utilized in place of a normal wire to form compound links. Specifically, many types of chains are formed by links of various shapes which are intertwined. Typically, those links are made from wire which is wrapped into a particular configuration to form a particular shaped link. The present invention contemplates the use of rope chain being used in place of wire to form compound links. Those compound links are then intertwined to form any particular type of rope chain or other chain type. Therefore, it is contemplated to use rope chain formed of any method to then form links and those links can be made into any new chain. Specifically, and not by way of any limitation, such chains can include a rope chain, a slalom chain, a Prima Donna chain, a Forsetina chain, a curb chain, a karo chain, a Byzantine chain, a hollow chain, a snapper chain, a Russian chain or any other type of chain utilizing links. All of such are included within the scope of the present invention.

A further aspect of the invention involves the method of interconnection of the various links. Historically, in a classic rope chain, alternate ones of the links are soldered together. In previously incorporated U.S. Pat. No. 4,651,517, using even ratios, sometimes adjacent links are soldered together and at other times, links are skipped. Typically, the reason for skipping links is to allow movement of one link against another to provide some flexibility in the formation of such rope chain.

Embodiments of the present invention further contemplate securing together all of the links in a chain. This may be done by soldering every one of the links, regardless of how they are formed, whether interconnected with the gaps oriented in one direction, in alternating directions, or in any other direction configuration. In doing so, the resulting chain will be substantially rigid. However, the final chain product may be bent or curved to form a particular chain shape or section that is desired. Note that with the inventive, substantially rigid chain, configurations that have an inner diameter to wire width ratio of less than 3:1 are possible. In fact, ratios such as 2:1 and 1:1 are possible.

Additionally or alternatively, instead of connecting each individual link together one at a time, the strand of wire that is typically used to hold the links together as they are assembled (regardless of which direction) may be a strand of solder. One or two strands may be used. Thereafter, the entire assembly of the links, together with the strand or strands, may be placed in a furnace to melt the solder so that the solder will flow between every one of the links and the links will then be secured together without having to individually solder them.

Alternatively, other means of securing all of the links together may be utilized. For example, if a standard wire, such as a steel wire or the like is used to hold the links together as they are assembled, paste may be placed on the entire line of assembled links. Thereafter, the paste may be heated to secure all of the links together, and then the strands may be removed. In other embodiments, acid may be used to remove the strands or the strands may be removed by other means. Other adhesives may alternatively or additionally be used. Thus, as all of the links are secured together, it is not necessary to individually solder links. Since the strand(s) contact all of the links, the soldering can be done automatically at one time without the need for individual labor cost of soldering individual, selective links.

As indicated above, once the resulting chain is formed, it is substantially rigid. However, the rigid chain may be bent or otherwise shaped into whatever shape is desired to form a particular article of jewelry.

It should also be appreciated that each and every aspect of the embodiments of the invention described herein may be performed either manually or by machine. Thus, all of the embodiments of the invention contemplate both man-made links and assembly, and machine-made links and assembly.

CONCLUSION

A new type of interwoven link configuration has been described. Links of any shape and any cross-section having a gap in the periphery are assembled with the gaps oriented in the same direction. The links are intertwined so as to overlie each other and thereby form a helix configuration. The links are held in place by a strand or two strands wound within the valleys of the helix configuration. The links are then secured to the strand and/or each other. The resulting configuration can be used as a rope chain itself or can be used as a typical wire to form other compound links for manufacturing other chain configurations.

In addition, links assembled by any classic method or any other method and formed into a rope chain, can also be used in place of a conventional wire to form compound links in accordance with the present invention. Such compound links can then be interconnected to form any other types of chains that are similarly formed by individual conventional links. Thus, a rope chain is used instead of wire to form compound links in the preparation of other types of chains.

Furthermore, whether the links are assembled oriented in the same direction or different directions, the present invention includes interconnecting al of the links together to form a rigid structure and thereafter bend the structure into a particular shape desired.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

The invention claimed is:

1. A rope chain comprising:

a plurality of intertwined links not soldered together, each link including a gap, the links oriented with gaps in the same direction and fitted together one against the other to form a helix configuration defining a first spiral valley and a second spiral valley; and a first wire intertwined around the helix configuration in the first spiral valley and permanently affixed to the rope chain intermittently along the length of the rope chain.

2. The chain of claim 1 wherein a ratio of an inner diameter of each link to a wire thickness of each link is less than 3:1.

3. The chain of claim 1, further comprising a second wire intertwined around the helix configuration in the second spiral valley.

4. The chain of claim 3, wherein the second wire is permanently affixed to the chain.

5. The chain of claim 1, wherein the first wire includes precious metal.

6. The chain of claim 1, wherein the first wire is permanently affixed to the chain by a bond.

7. The chain of claim 1, wherein the chain is substantially rigid.

8. The chain of claim 1, wherein the chain is wound on a mandrel into a spiral of the chain and cut into individual turns of the chain to form links of the chain, and said links of chain are further interwoven to form a second chain.

9. A method comprising:

assembling a plurality of links into a helix configuration wherein each link includes a gap and each link is oriented so that the gaps each open in the same direction;

wrapping a strand into a valley of the helix configuration; and permanently affixing the strand into the valley of the helix configuration intermittently along the length of the helix configuration.

10. The method of claim 9 further comprising forming the helix configuration into a compound link.

11. The method of claim 10 further comprising assembling a plurality of compound links to form a second chain.

12. The method of claim 9 further comprising securing adjacent ones of the plurality of links to each other.

13. The method of claim 9 further comprising wrapping an additional strand into another valley of the helix configuration.

14. The method of claim 9 wherein the strand includes solder and further comprising melting the solder to connect adjacent ones of the plurality of links to each other.

15. A method comprising:

providing a rope chain formed of a plurality of links;

wrapping the chain around a mandrel and soldering the rope chain intermittently along the length of the wrapped rope chain;

cutting the soldered and wrapped rope chain to form compound links with a gap; and assembling the compound links by placing successive compound links in a gap of a preceding link and forming a second chain.

16. The method of claim 15 wherein assembling the compound links into a second chain includes assembling the compound links into a compound rope chain.

17. A chain element comprising:

a first compound link formed with a gap;

a second compound link formed with a gap interwoven with the gap of the first compound link;

a third compound link formed with a gap interwoven with the gap of the second compound link; and a fourth compound link formed with a gap interwoven with the gap of the third compound link, wherein the compound links are each formed from a length of rope chain shaped to form a link, and the interweaving of the compound links creates a new chain.

18. A chain comprising a plurality of the chain elements of claim 17 coupled together.

19. A method comprising:

providing a first chain;

wrapping the chain around a mandrel and soldering the chain intermittently along the length of the wrapped chain;

cutting the soldered and wrapped rope chain to form compound links with a gap; and assembling the compound links by placing successive compound links in a gap of a preceding link and forming a second chain.

20. The method of claim 19, wherein the first chain is comprised of links which are fixed together to form a wire from which the compound links are formed.

21. The method of claim 19, wherein the first chain is selected from the group consisting of slalom chain, Prima chain, Donna chain, Forsetina chain, curb chain, karo chain, Byzantine chain, hollow chain, snapper chain, and Russian chain.

22. The method of claim 19 wherein forming a plurality of compound links includes shaping the compound links on a mandrel.

23. The method of claim 19 wherein said second chain has some links in one direction and other in a second direction.

24. The method of claim 19, wherein the second chain is formed into a form selected from the group consisting of slalom chain, Prima chain, Donna chain, Forsetina chain, curb chain, karo chain, Byzantine chain, hollow chain, snapper chain, and Russian chain.

25. The method of claim 19, wherein one or more of the links of the second chain are soldered together.

26. The method of claim 19, wherein in the second chain comprises:

a plurality of intertwined links oriented with gaps in the same direction and fitted together one against the other to form a helix configuration defining a first spiral valley and a second spiral valley; and a first wire intertwined around the helix configuration in the first spiral valley and permanently affixed to the chain.

* * * * *